US007845381B2

(12) United States Patent
Liu

(10) Patent No.: US 7,845,381 B2
(45) Date of Patent: Dec. 7, 2010

(54) ADHESIVE TAPE CUTTER

(76) Inventor: Yu Chin Liu, 13F, No. 23, Jiun-Ho Street, Beitun District, Taichung (TW) 406

( * ) Notice: Subject to any disclaimer, the term of this patent is extended or adjusted under 35 U.S.C. 154(b) by 161 days.

(21) Appl. No.: 12/172,272

(22) Filed: Jul. 14, 2008

(65) Prior Publication Data

US 2009/0301660 A1 Dec. 10, 2009

Related U.S. Application Data

(63) Continuation-in-part of application No. 12/136,057, filed on Jun. 10, 2008, now abandoned.

(51) Int. Cl.
*B32B 38/04* (2006.01)

(52) U.S. Cl. ..... 156/527

(58) Field of Classification Search ..... 156/510, 156/574, 577

See application file for complete search history.

(56) References Cited

U.S. PATENT DOCUMENTS 3,132,783 A * 5/1964 Duncan ..... 225/25
3,349,979 A * 10/1967 Costello ..... 225/44
3,410,465 A * 11/1968 Costello ..... 225/65
3,725,182 A * 4/1973 Regan ..... 156/527
4,253,905 A * 3/1981 Regan ..... 156/523
5,904,806 A * 5/1999 Mendelovich et al. ..... 156/579
7,441,581 B2 * 10/2008 Pitzen ..... 156/577

* cited by examiner

*Primary Examiner*—Khanh Nguyen
*Assistant Examiner*—Margaret Squalls
(74) *Attorney, Agent, or Firm*—Pro-Techtor Int'l Services; Ralph Willgohs

(57) ABSTRACT

An adhesive tape cutter comprising a pair of protecting portions formed in pair at the right and left sides for fitting and cutting an adhesive tape roll. The top of the protecting portions includes a tape-guiding slot and a tape-attaching portion while a slide slot portion is formed at a side wall of the protecting portions. The slide cap is fitted with a cutting edge, and the slide cap further includes a sliding piece that fits into the slide slot portion in such a manner that a proper sliding action is achieved. An elastic supporting piece is integrally formed within a tape-receiving space defined by the protecting portions such that that the elastic supporting piece can be pushed against the adhesive tape roll at any time. In this way, a certain clamping relationship between the adhesive tape roll and the protecting portions is constantly maintained.

10 Claims, 11 Drawing Sheets

ADHESIVE TAPE CUTTER

This patent application is a continuation-in-part application of U.S. patent application Ser. No. 12/136,057, filed Jun. 10, 2008.

BACKGROUND OF THE INVENTION

1. Fields of the Invention

The invention relates to an adhesive tape cutter, and more particularly, to an adhesive tape cutter that achieves a practical effect and ensures an easy operation.

2. Description of the Related Art

The present invention is a continuation-in-part from U.S. Provisional Patent Application Ser. No. 12/136,057. There are different types of adhesive tape rolls in the market, such as household adhesive tape rolls, medical adhesive tape rolls, adhesive tape rolls for the industrial use, adhesive tape rolls for the packing purpose, adhesive tape rolls for electric isolation, and even the water-resisting adhesive tape rolls, etc. They all have their own specifications, sizes, and types. Moreover, they have different operation ways. In order to meet these different complicated requirements, a further improvement is done for extending the application scope and increase the practical value.

SUMMARY OF THE INVENTION

A primary object of the invention is to eliminate the drawbacks of the prior art and to provide an adhesive tape cutter that includes protecting portions capable of application to the adhesive tape roll having different appearances under the basic conditions of the same components, thereby considerably extending the application scope and increasing the practical value.

According to the invention, an adhesive tape cutter comprising a pair of protecting portions formed in pair at the right and left sides for fitting and cutting an adhesive tape roll. The top of the protecting portions includes a tape-guiding slot and a tape-attaching portion while a slide slot portion is formed at a side wall of the protecting portions. The slide cap is fitted with a cutting edge, and the slide cap further includes a sliding piece that fits into the slide slot portion in such a manner that a proper sliding action is achieved. An elastic supporting piece is integrally formed within a tape-receiving space defined by the protecting portions such that that the elastic supporting piece can be pushed against the adhesive tape roll at any time. In this way, a certain clamping relationship between the adhesive tape roll and the protecting portions is constantly maintained.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
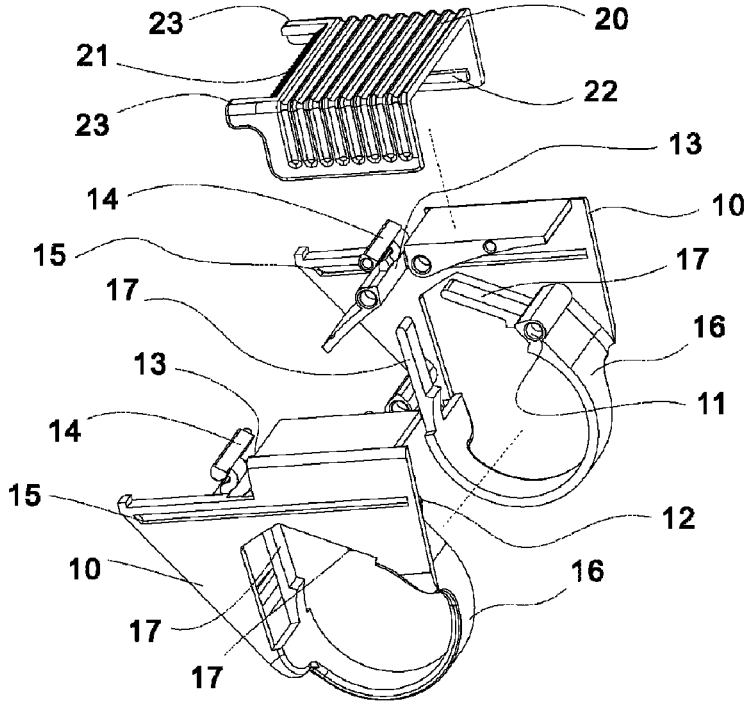
FIG. 1 is an exploded perspective view of a first embodiment of an adhesive tape cutter in accordance with the invention.
Figure 2:
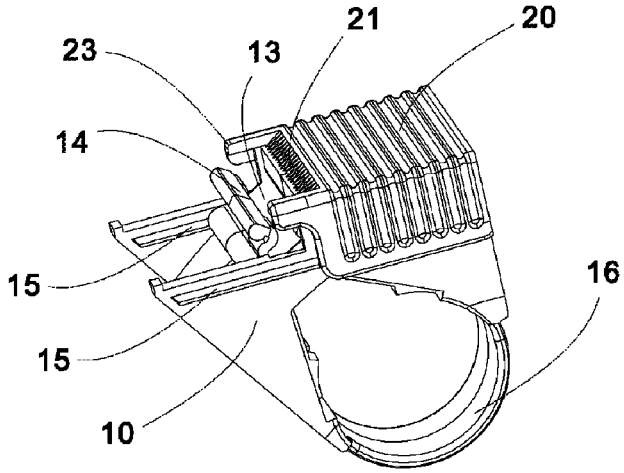
FIG. 2 is a perspective assembly view according to FIG. 1.
Figure 3:
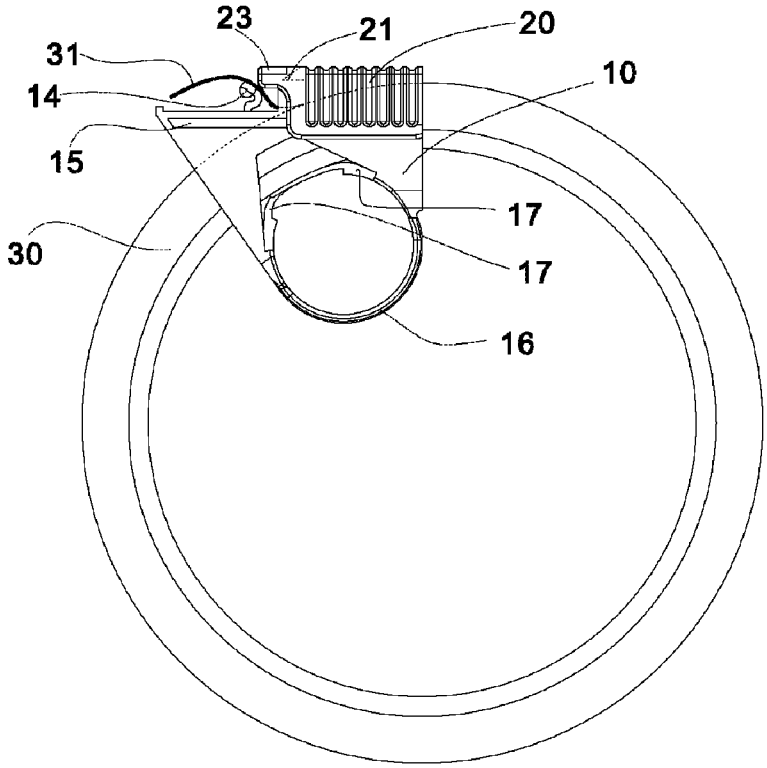
FIG. 3 is an application view according to FIG. 1.

Referring to FIGS. 1 through 3, an adhesive tape cutter in accordance with a first embodiment of the invention is suitable for application to an adhesive tape roll 30 for the industrial and packing purpose. The adhesive tape cutter includes a pair of protecting portions 10 and a slide cap 20.

The protecting portions 10 are formed in a clamshell pair as a right-hand member and left-hand member, and are provided with a plurality of locking holes 11 and locking projections 12, respectively, at mating locations for joining the pair to each other. The top of each of the protecting portions 10 includes a tape-guiding slot 13 and a tape-attaching portion 14. A slide slot portion 15 is formed at a side wall of each of the protecting portions 10. A slide cap 20 engages both the right-hand side and a left-hand side protecting portions, and covers the tape-guiding slot 13 and the tape-attaching portion 14. The slide cap 20 is fitted with a cutting edge 21. The slide cap 20 further includes a sliding piece 22 that fits into the slide slot portion 15 in such a manner that a proper sliding action is achieved. In addition, an inner rim of each of the protecting portions 10 includes a mounting frame 16 which in assembly is fitted into an internal hole of the adhesive tape roll 30. An elastic supporting piece 17 is formed at the top of each of the mounting frames 16 such that the elastic supporting piece 17 can be pushed against a corresponding portion in the internal hole of the adhesive tape roll 30 at any time. In this way, a certain clamping relationship between the adhesive tape roll 30 and the protecting portions 10 is constantly maintained.

The slide cap 20 includes a sliding piece 22 on an inner sidewall on each side engaging the slide slot portion 15 of the right-hand and the left-hand protecting portions 10, respectively. A cutting edge 21 is formed at a top position corresponding to the tape-attaching portion 14. Meanwhile, an extension tongue 23 is formed at both sides of the cutting edge 21, respectively, and projects forward beyond the cutting edge to contact the tape attaching portion 14 when the slide cap 20 is advanced.

An easy assembly of the above-mentioned components and the adhesive tape roll 30 is shown in FIG. 3, the right-hand and the left-hand protecting portions 10 are fitted from the right-hand and the left-hand sides of the adhesive tape roll 30, respectively, with the mounting frames 16 positioned in the internal hole of the adhesive tape roll 30. The adhesive tape 31 is extended from the tape-guiding slots 13 of the protecting portions 10 while the tape-attaching portion 14 is used for positioning the adhesive side of the adhesive tape 31. At the same time, the elastic supporting pieces 17 are brought into a bent position. Consequently, a certain clamping relationship between the adhesive tape roll 30 and the protecting portions 10 is constantly maintained by the self-resilience of the elastic supporting pieces 17. Therefore, the use of the adhesive tape 31 is done in the following steps. The slide cap 20 is pushed backward first such that the tape-attaching portion 14 is exposed. Thereafter, a certain amount of the adhesive tape 31 is pulled out and the slide cap 20 is pushed forward such that the tape-attaching portion 14 is hidden within the slide cap 20. Finally, the adhesive tape 31 is moved toward the cutting edge 21 in contact therewith for the cutting purpose. In other words, a certain length of the adhesive tape 31 is left within the open space at the front end of the protecting portions by use of the attaching effect of the tape-attaching portion 14 when the pulling and cutting steps of the adhesive tape 31 are done. Meanwhile, the adhesive tape 31 won't be rolled backward. In this way, a smooth use of the adhesive tape 31 is ensured by performing the pushing and cutting steps of the slide cap 20.

A proper clamping force is constantly maintained between the adhesive tape roll 30 and the protecting portions 10. It is only required to move the protecting portions 10 in a reverse direction relative to the adhesive tape roll 30 when the adhesive tape 31 is excessively pulled out by mistake. In this way, the excessive adhesive tape 31 can be rewound to avoid an unnecessary waste.

Figure 4:
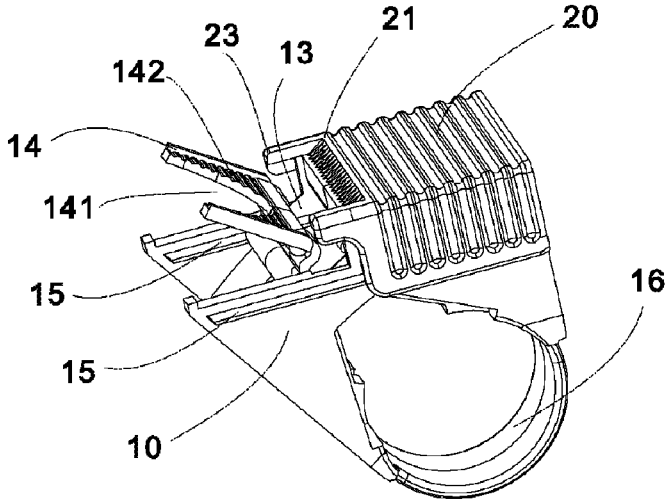
FIG. 4 is a perspective view of a second embodiment of an adhesive tape cutter in accordance with the invention.
Figure 21:
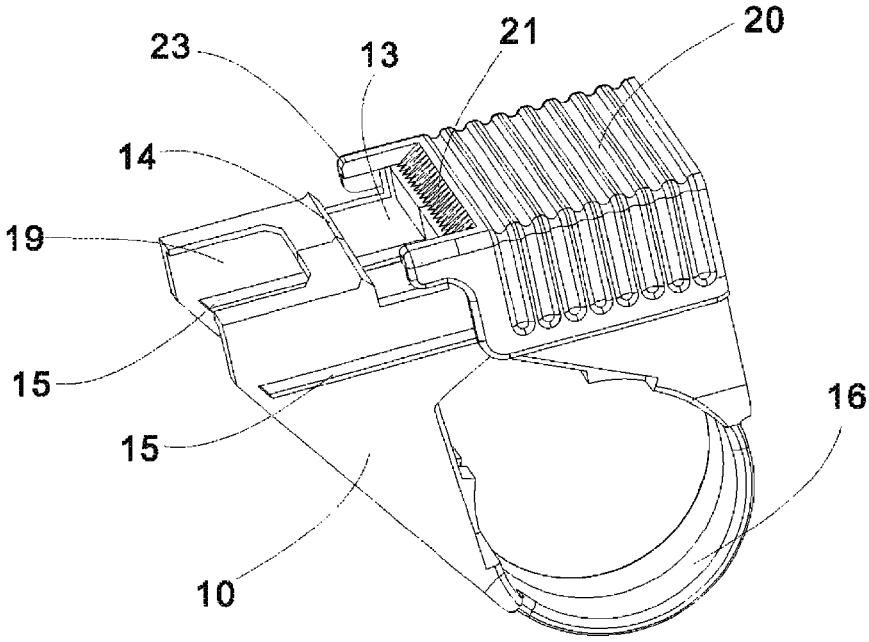
FIG. 21 is a perspective view of a seventeenth embodiment of an adhesive tape cutter in accordance with the invention.

FIG. 4 illustrates a second embodiment of the adhesive tape cutter in accordance with the invention. Likewise, the tape-attaching portion 14 can be formed in an angularly protruding shape which is inclined at an upward angle away from the cutting edge. Moreover, the tape-attaching portion 14 includes a slot 141 for an easy holding of the adhesive tape 31 with fingers of the user. Of course, the tape-attaching portion 14 can be provided with corrugations 142 for an effective protection of the adhesive tape 31 from an excessive attachment to the surface of the tape-attaching portion 14. When the slide cap 20 is moved forward, the extension tongue 23 at the front end thereof is pushed against the tape-attaching portion 14 to be bent downward in a hidden position. In releasing the slide cap 20, the tape-attaching portion 14 automatically springs upward such that an easy take-out of the adhesive tape 31 is ensured. According to another preferred embodiment shown in FIG. 21, a prearranged slot 19 is formed for an easy takeout of the adhesive tape 31 as well.

Figure 5:
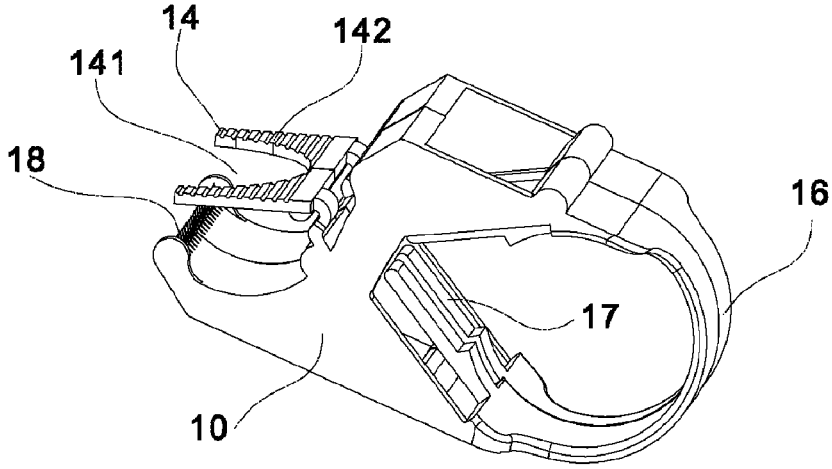
FIG. 5 is a perspective view of a third embodiment of an adhesive tape cutter in accordance with the invention.

FIG. 5 shows a third embodiment of the adhesive tape cutter in accordance with the invention. According the third embodiment, the protecting portions 10 have all of the above-mentioned features. Meanwhile, a cutting edge 18 is formed at the front end of the protecting portions 10 for achieving the same effect. Therefore, the slide cap 20 is no longer necessary so that the amount of the necessary components can be reduced. Thus, an economical and practical effect is achieved.

Figure 6:
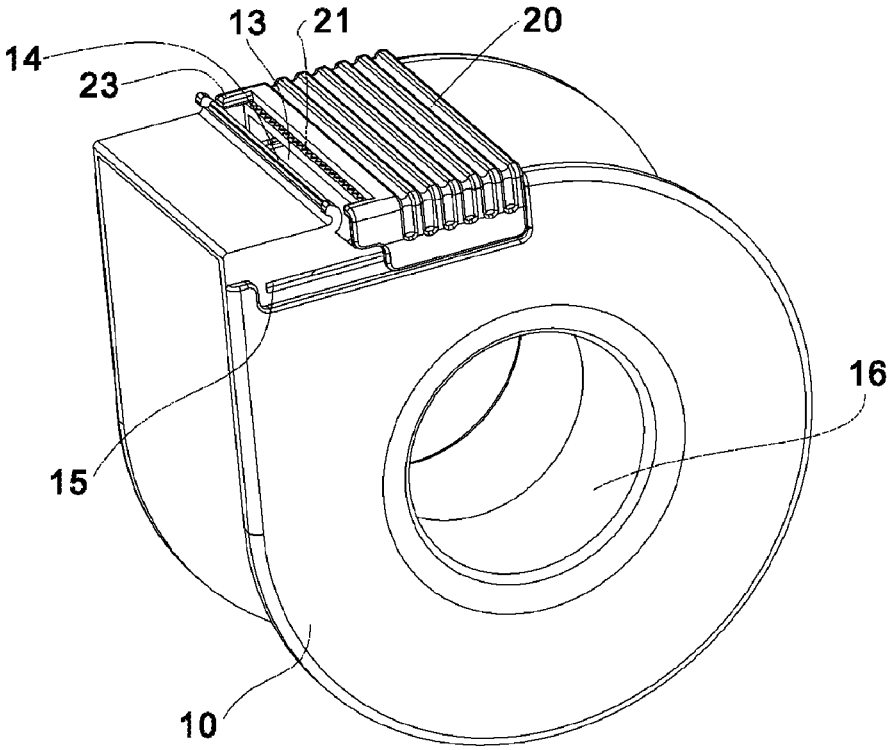
FIG. 6 is a perspective view of a fourth embodiment of an adhesive tape cutter in accordance with the invention.
Figure 7:
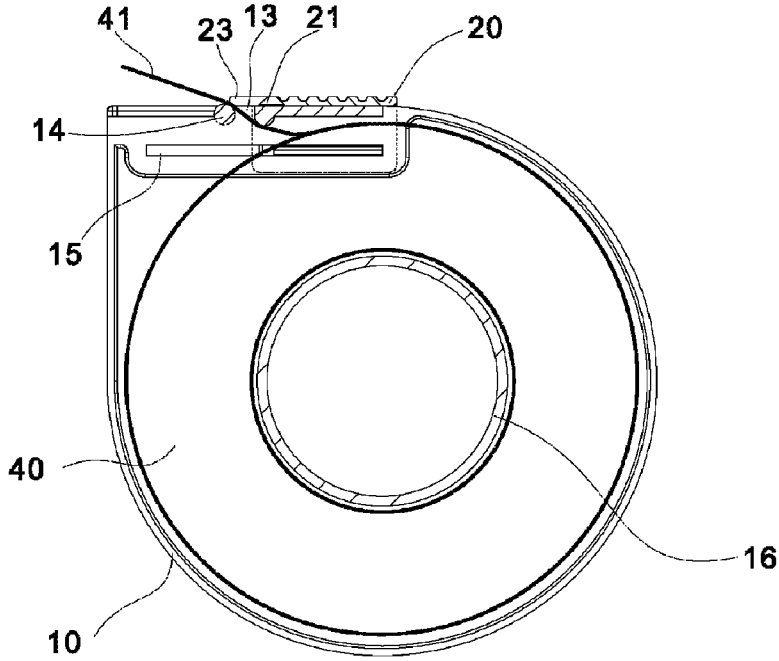
FIG. 7 is an application view according to FIG. 6.
Figure 8:
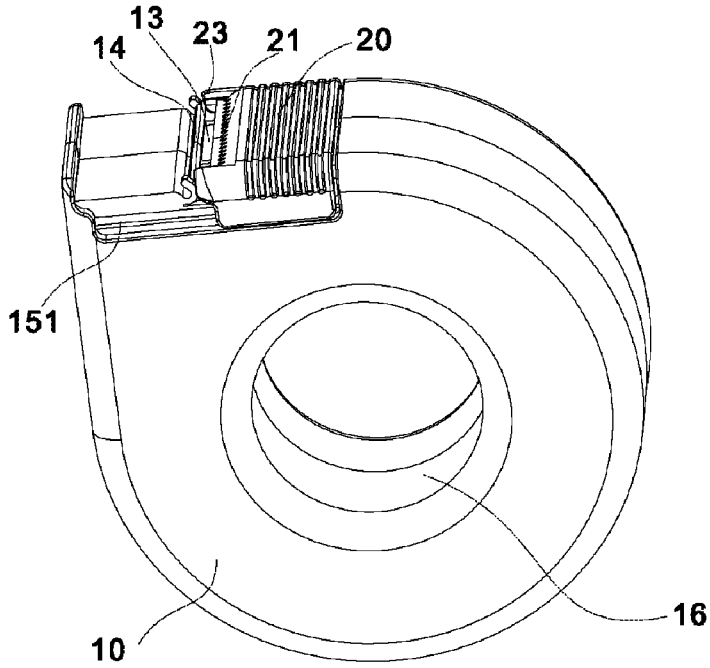
FIG. 8 is a perspective view of a fifth embodiment of an adhesive tape cutter in accordance with the invention.
Figure 9:
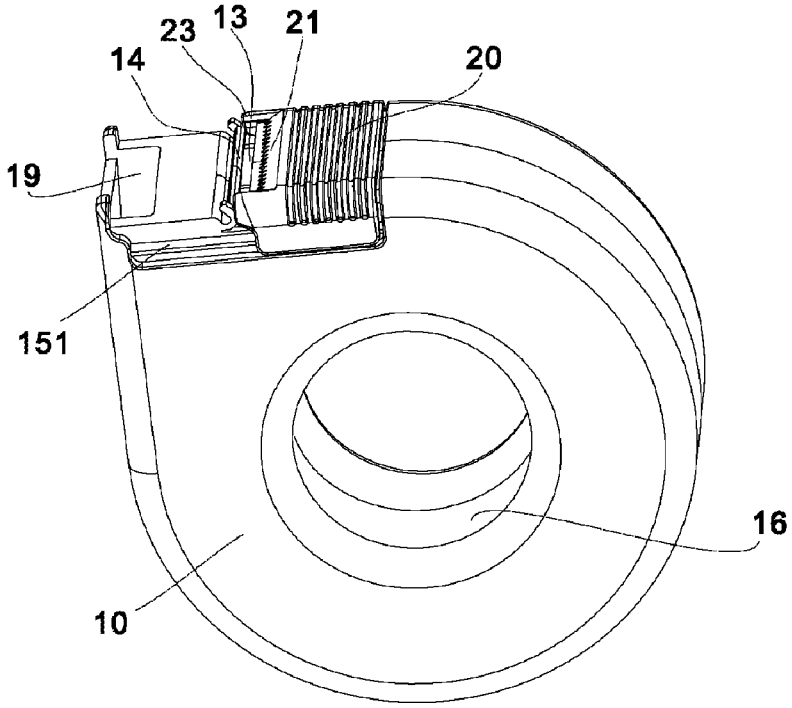
FIG. 9 is a perspective view of a sixth embodiment of an adhesive tape cutter in accordance with the invention.

FIGS. 6 and 7 show a fourth embodiment of the adhesive tape cutter in accordance with the invention. According the fourth embodiment, it is related to an adhesive tape roll 40 for the medical or electric use. The protecting portions 10 are formed in a shape of a box cover such that the adhesive tape roll 40 for the medical or electric use is completely covered within the protecting portions 10.

Figure 10:
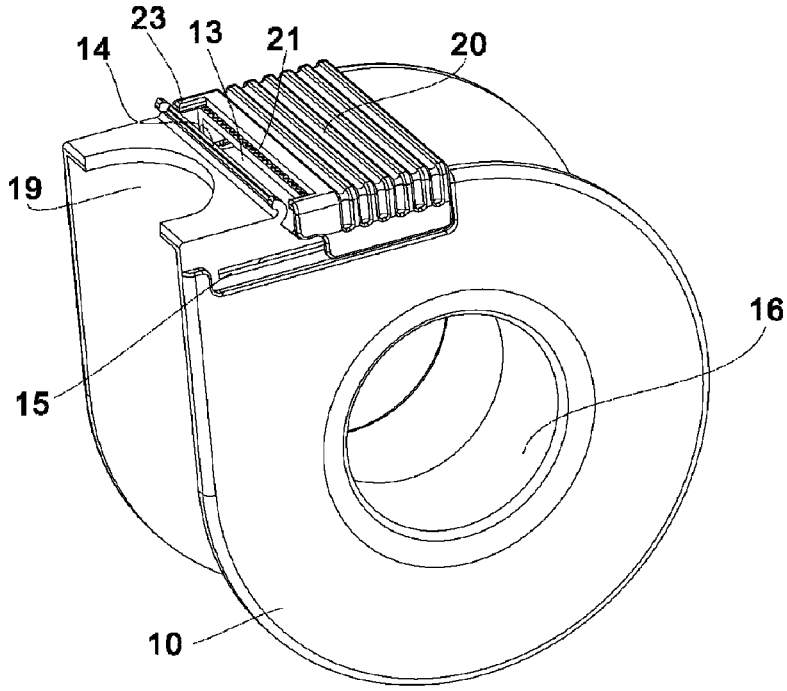
FIG. 10 is a perspective view of a seventh embodiment of an adhesive tape cutter in accordance with the invention.
Figure 11:
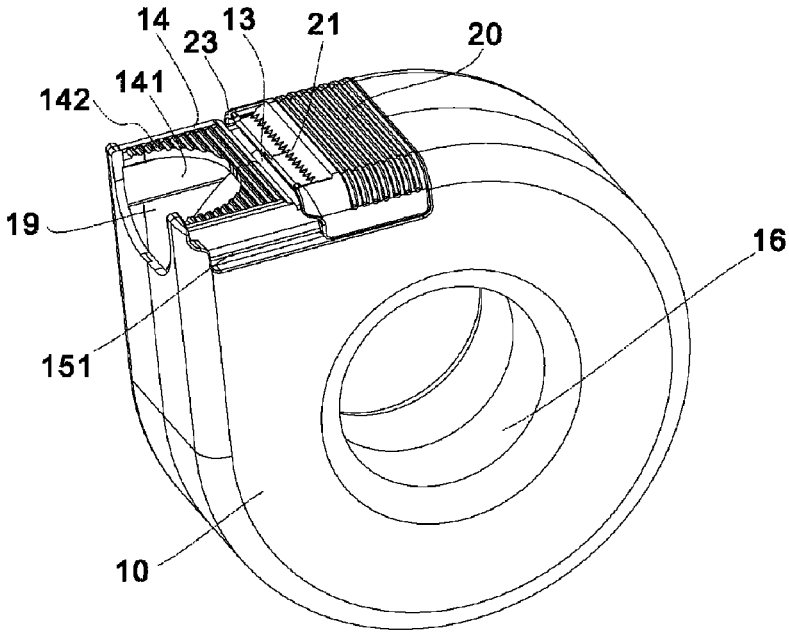
FIG. 11 is a perspective view of a eighth embodiment of an adhesive tape cutter in accordance with the invention.
Figure 12:
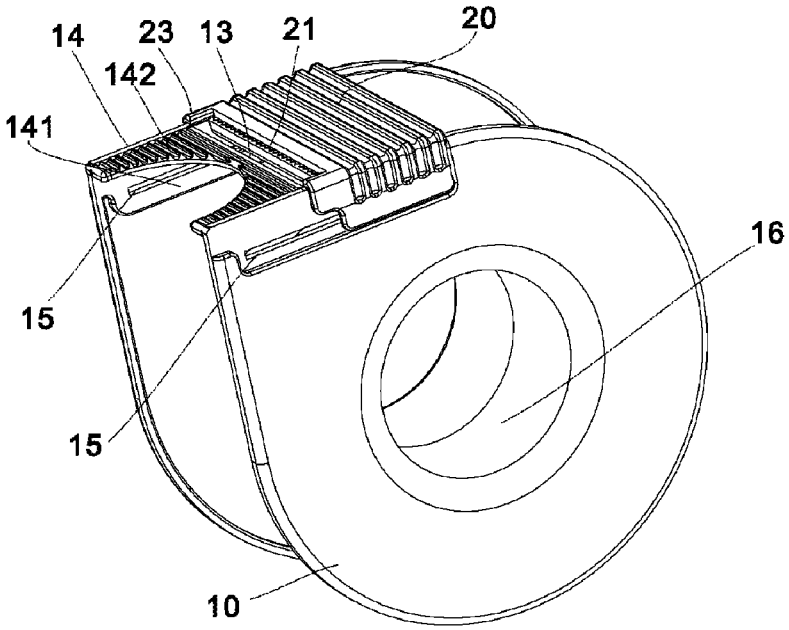
FIG. 12 is a perspective view of a ninth embodiment of an adhesive tape cutter in accordance with the invention.

According to other embodiments in FIGS. 8, 9, 11 and 13, the protecting portions 10 is entirely covered. According to other embodiments in FIGS. 10, 12 and 14, the protecting portions 10 is integrally formed in a side-covering shape. Of course, a prearranged slot 19 can be formed for an easy take-out of the adhesive tape 41 as well.

Figure 13:
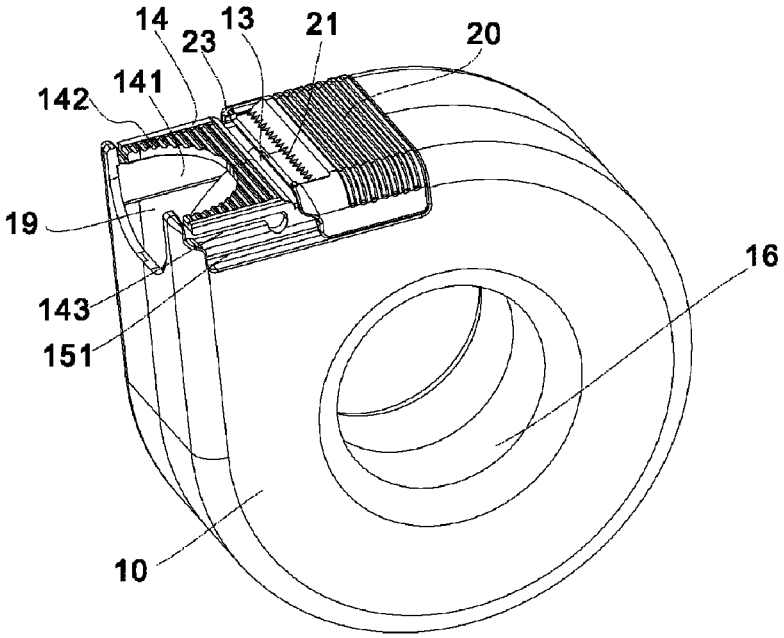
FIG. 13 is a perspective view of a tenth embodiment of an adhesive tape cutter in accordance with the invention.
Figure 14:
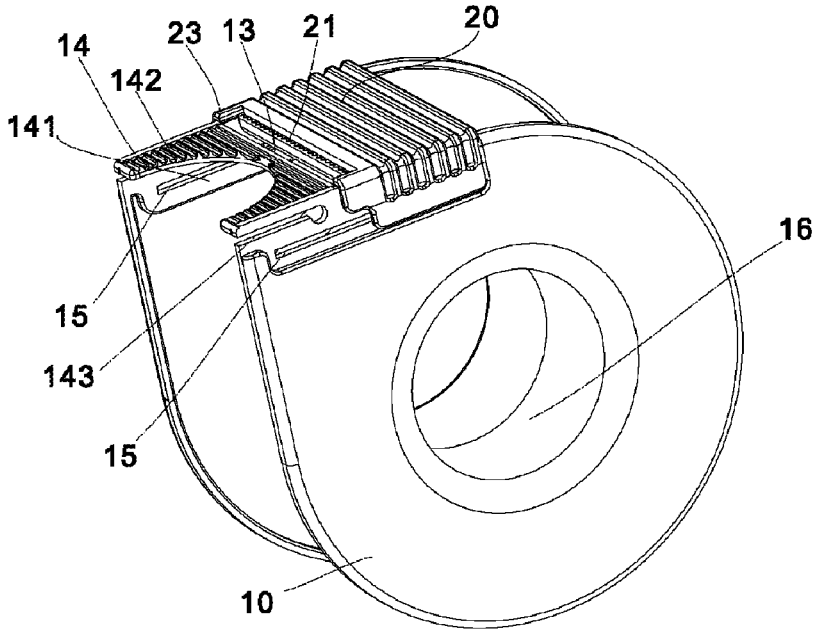
FIG. 14 is a perspective view of a eleventh embodiment of an adhesive tape cutter in accordance with the invention.
Figure 15:
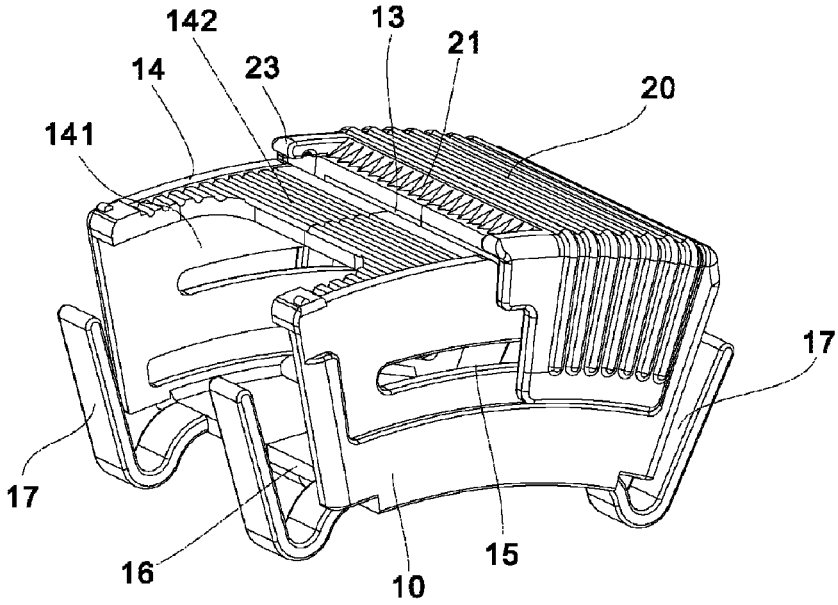
FIG. 15 is a perspective view of a twelfth embodiment of an adhesive tape cutter in accordance with the invention.
Figure 16:
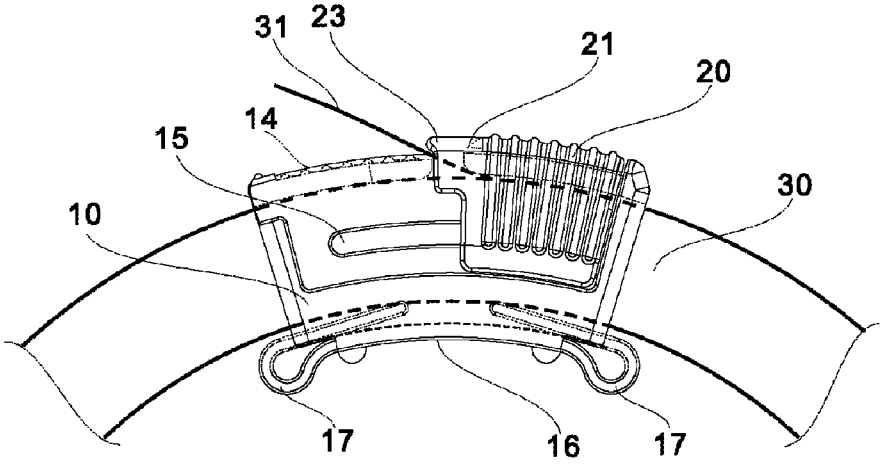
FIG. 16 is an application view according to FIG. 15.
Figure 17:
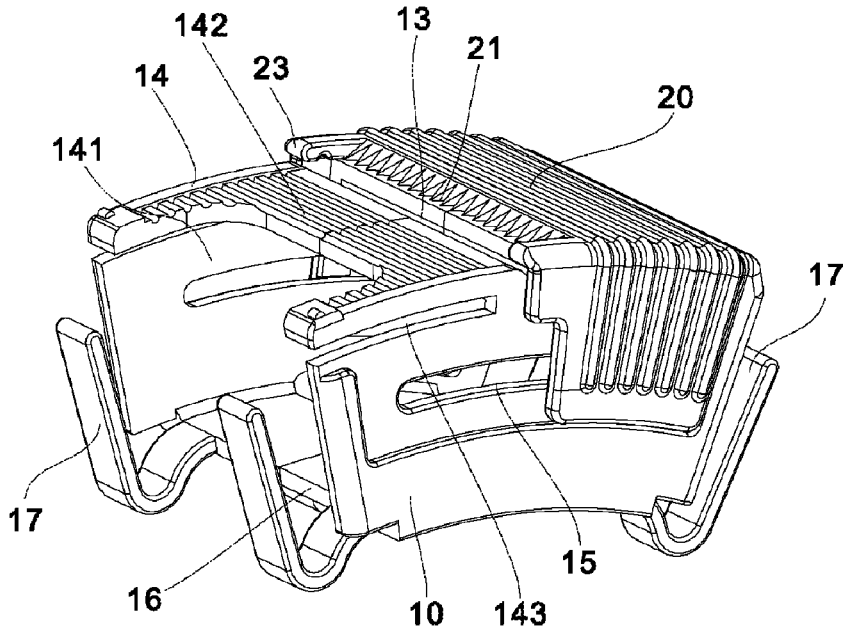
FIG. 17 is a perspective view of a thirteenth embodiment of an adhesive tape cutter in accordance with the invention.
Figure 18:
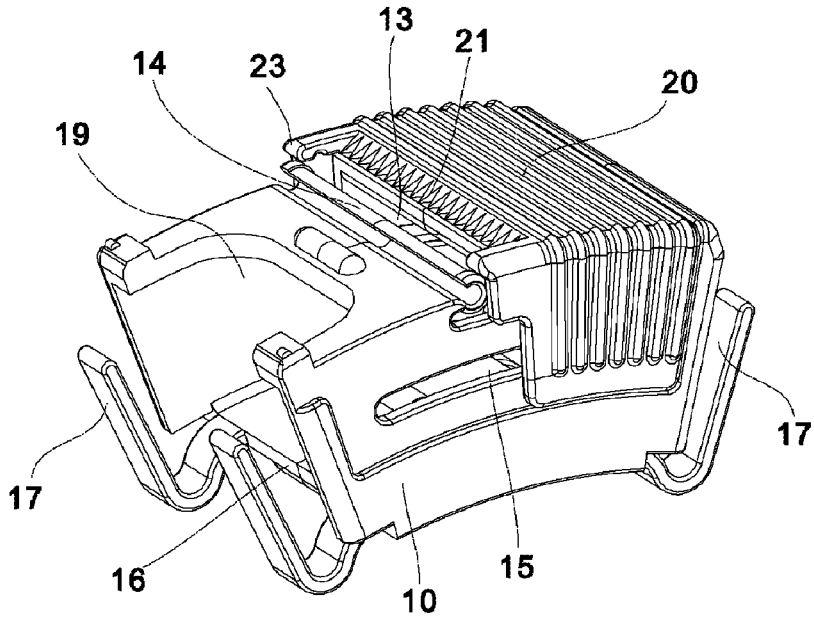
FIG. 18 is a perspective view of a fourteenth embodiment of an adhesive tape cutter in accordance with the invention.
Figure 19:
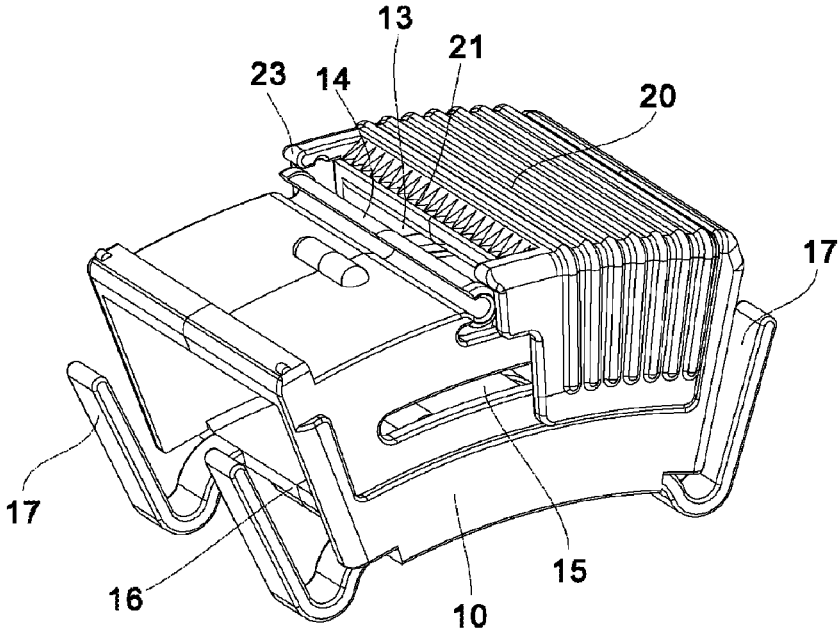
FIG. 19 is a perspective view of a fifteenth embodiment of an adhesive tape cutter in accordance with the invention.

According to FIGS. 13 and 14, the tape-attaching portion 14 of the protecting portions 10 includes an open slot 143 for a slightly inclined extension in accordance with the arched shape of the medical or electric adhesive tape roll 40 when the medical or electric adhesive tape roll 40 is filled. In this way, an easy take-out of the adhesive tape 41 is achieved as well.

According to FIGS. 8, 9, 11 and 13, the slide slot portion 15 is replaced by a slide groove 151 that won't diminish the original effect.

According to FIGS. 15 through 19, the adhesive tape cutter has the above-mentioned design features. Moreover, a clamping arrangement is applied to a conventional adhesive tape roll 30. Thus, all of the original effects are achieved. Concluding from the above-mentioned drawings and the individual tiny modifications, an effective and complete match to each other as well as a smooth application is ensured no matter how long the tape-attaching portion 14 is; no matter if the slot 141, corrugations 142 and the open slot 143 are present; whether the slide slot portion 15 or the slide groove 151 is formed; no matter how the protecting portions 10 correspond to the internal diameter of the adhesive tape roll 30, 40 and the styles of the mounting frames 16.

Figure 20:
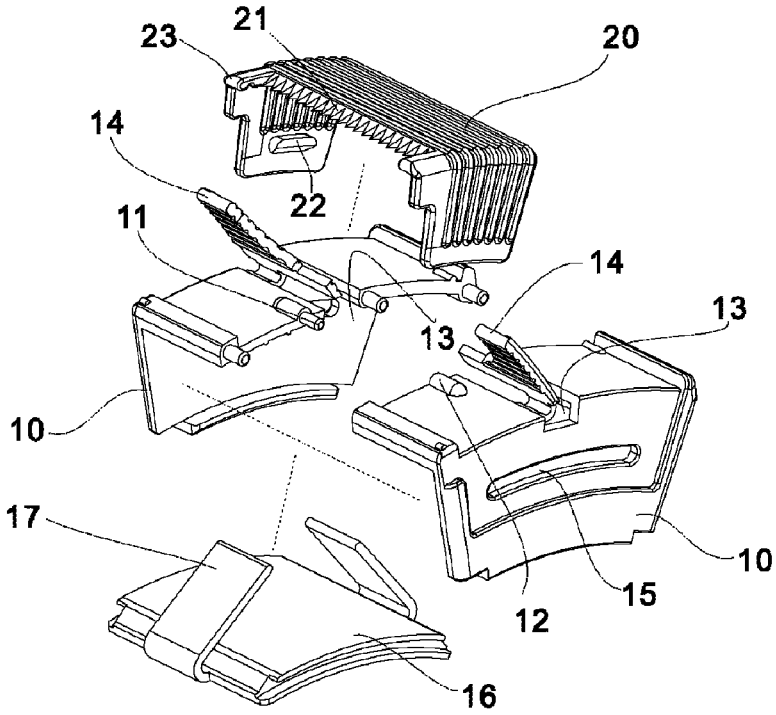
FIG. 20 is a perspective view of a sixteenth embodiment of an adhesive tape cutter in accordance with the invention.

As shown in FIG. 20, the protecting portions 10 and the mounting frame 16 are separately formed in taking the adhesive tape roll (not shown) with special types and dimensions into account. Both of them can easily fit into each other such that an effective utilization is achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An adhesive tape cutter comprising a two-part housing split on a vertical parting plane to form a pair of protecting portions in a clamshell pair with a right-hand member and a left-hand member, each being provided with a plurality of locking holes and locking projections at mating locations for joining the pair to each other for fitting and cutting an adhesive tape roll, and a slide cap;

wherein the top of each of the protecting portions includes a tape-guiding slot and a moveable tape-attaching portion, a slide slot portion is formed at a side wall of each of the protecting portions;

wherein the slide cap is fitted with a cutting edge, and the slide cap further includes a sliding piece on an inner surface of the right-hand and left-hand sidewall that fits into the right-hand and left-hand slide slot portion respectively in such a manner that a proper sliding action is achieved.

2. The adhesive tape cutter as recited in claim 1, wherein an elastic supporting piece is integrally formed within a tape-receiving space defined by the protecting.

3. The adhesive tape cutter as recited in claim 1, wherein the tape-attaching portion further comprises an angularly protruding shape inclined at an upward angle away from the cutting edge.

4. The adhesive tape cutter as recited in claim 1, wherein the protecting portions are each formed in a shape of a box cover such that the adhesive tape roll is completely covered within the protecting portions.

5. The adhesive tape cutter as recited in claim 1, wherein the bottom of the tape-attaching portion of the protecting portions is provided with an open slot.

6. The adhesive tape cutter as recited in claim 1, wherein the protecting portions include a slot at a position adjacent to the tape-attaching portion for an easy take-out of the adhesive tape.

7. The adhesive tape cutter as recited in claim 1, wherein the slide slot portions of the protecting portions include a sliding groove.

8. An adhesive tape cutter comprising:

a) a two-part housing split on a vertical parting plane to form a pair of protecting portions formed in a clamshell pair with a right-hand and a left-hand member, each provided with a plurality of locking holes and locking projections, respectively, for joining to each other, the protecting portions having integrally formed elastic supporting pieces with a bendable attachment, the top of the protecting portions having a tape-guiding slot and a tape-attaching portion while a slide slot portion is formed at a side wall of the protecting portions, a mounting frame being formed at opposing internal sides of the protecting portions, the mounting frame having an elastic supporting piece such that a certain clamping relationship between the adhesive tape roll and the protecting portions is constantly maintained; and b) a slide cap having a sliding piece corresponding to the slide slot portion of the protecting portions, a cutting edge being formed at a top position corresponding to the tape-attaching portion, an extension tongue being formed at both sides of the cutting edge, and projecting forward beyond the cutting edge to contact the tape attaching portion when the slide cap is advanced.

9. The adhesive tape cutter as recited in claim 8, wherein the protecting portions and the mounting frames are separately formed.

10. An adhesive tape cutter comprising a two-part housing split on a vertical parting plane to form a pair of protecting portions in a clamshell pair with a right-hand member and a left-hand member for fitting and cutting an adhesive tape roll, wherein the top of the protecting portions includes a tape-attaching portion extending in an inclined manner and a tape-guiding slot;

wherein an inner rim of each of the protecting portions includes a mounting frame which in assembly is fitted into includes a mounting frame an internal hole of the adhesive tape roll, and an elastic supporting piece is formed at the top of the mounting frame such that the elastic supporting piece can be pushed against a corresponding portion in the internal hole of the adhesive tape roll at any time; thus, a certain clamping relationship between the adhesive tape roll and the protecting portions is constantly maintained; and wherein a cutting edge is formed at the front end of the protecting portions.

* * * * *